US010960260B1

(12) United States Patent
Weber

(10) Patent No.: US 10,960,260 B1
(45) Date of Patent: Mar. 30, 2021

(54) WEDGE SHAPED FITNESS ACCESSORY

(71) Applicant: Kurt Weber, Costa Mesa, CA (US)

(72) Inventor: Kurt Weber, Costa Mesa, CA (US)

( * ) Notice: Subject to any disclaimer, the term of this patent is extended or adjusted under 35 U.S.C. 154(b) by 0 days.

(21) Appl. No.: 16/676,257

(22) Filed: Nov. 6, 2019

Related U.S. Application Data

(60) Provisional application No. 62/768,264, filed on Nov. 16, 2018.

(51) Int. Cl.
*A63B 21/00* (2006.01)
*A63B 23/04* (2006.01)

(52) U.S. Cl.
CPC ..... *A63B 21/4039* (2015.10); *A63B 23/04* (2013.01); *A63B 2208/0252* (2013.01)

(58) Field of Classification Search
CPC ..... A63B 21/4039; A63B 23/04; A63B 2208/0252; A47G 9/1009; A47G 2009/1018; A47G 9/1027
See application file for complete search history.

(56) References Cited

U.S. PATENT DOCUMENTS 2,931,510 A * 4/1960 Buck ..... A47F 7/02 211/1
2,981,318 A * 4/1961 Lincoln ..... A47C 7/30 297/452.52
3,262,134 A * 7/1966 Bramble, Jr. ..... A63B 6/00 5/420
3,389,411 A * 6/1968 Emery ..... A47C 21/022 5/490
3,532,336 A * 10/1970 Baker ..... A61G 13/12 5/650
4,265,232 A * 5/1981 Stonich ..... A61F 5/37 128/877
4,392,489 A * 7/1983 Wagner, Sr. ..... A61F 5/0193 5/650
5,137,333 A * 8/1992 Chee ..... A47C 7/029 297/452.21
5,476,105 A * 12/1995 Toth ..... A47C 20/021 128/DIG. 20
6,154,904 A * 12/2000 Ehredt ..... A45C 3/10 5/639
6,371,894 B1 * 4/2002 Hill ..... A63B 21/00047 128/845
6,881,179 B2 * 4/2005 Mostardi ..... A63B 21/0023 482/44
7,278,987 B2 * 10/2007 Solazzo ..... A61B 90/11 206/571
7,452,313 B2 * 11/2008 Endelman ..... A63B 21/00047 482/140
RE43,981 E * 2/2013 Endelman ..... A63B 21/4037 482/142

(Continued)

*Primary Examiner* — Garrett K Atkinson
(74) *Attorney, Agent, or Firm* — Plager Schack LLP; Mark H. Plager; Kara Verryt

(57) ABSTRACT

A fitness accessory for improving positioning and form during a frog pump exercise may include a wedge shaped device. The wedge shaped device may include a base; a top opposite the base; a pair of angled side walls connecting the base and the top; a first smaller end closing a first end of the wedge shaped device; and a second larger end closing a second end of the wedge shaped device. The device may taper from a larger width at the second end to a smaller width at the first end.

4 Claims, 4 Drawing Sheets

(56) References Cited

U.S. PATENT DOCUMENTS 8,376,920 B2 * 2/2013 Anderson ..... A63B 23/0211 482/140
9,084,704 B2 * 7/2015 Oberst ..... A61G 7/075
9,539,468 B2 * 1/2017 Nagasaka ..... A63B 22/16
D824,467 S * 7/2018 Rademacher ..... D21/803
10,130,836 B2 * 11/2018 Madion ..... A63B 23/0211
10,251,808 B1 * 4/2019 Theis ..... A61H 19/32
2005/0020417 A1 * 1/2005 Gary ..... A63B 21/028 482/140
2007/0117695 A1 * 5/2007 Endelman ..... A63B 21/4037 482/140
2007/0173391 A1 * 7/2007 Edwards ..... A63B 21/00047 482/142
2012/0260428 A1 * 10/2012 Franklin ..... A47G 9/1081 5/636
2014/0189955 A1 * 7/2014 Alletto, Jr. ..... A47G 9/0253 5/636
2014/0256525 A1 * 9/2014 Mueller ..... A61H 1/0292 482/142
2015/0025606 A1 * 1/2015 Davis ..... A61F 7/02 607/104
2016/0000242 A1 * 1/2016 Campagna ..... A61G 13/122 5/632
2016/0106225 A1 * 4/2016 Ham ..... A47C 27/081 5/655.3
2016/0152168 A1 * 6/2016 Ito ..... A47C 27/14 297/452.48
2017/0172331 A1 * 6/2017 Publicover ..... A63B 21/4037
2017/0246719 A1 * 8/2017 Pellenc ..... A01G 3/037
2018/0008064 A1 * 1/2018 Dudonis ..... A47G 9/10
2018/0214327 A1 * 8/2018 Stokesbary ..... A47G 9/1081
2019/0053648 A1 * 2/2019 Santizo ..... A47C 20/021
2019/0313817 A1 * 10/2019 Morden ..... A47G 9/109
2019/0365553 A1 * 12/2019 Drivere ..... A61F 5/01
2020/0100606 A1 * 4/2020 Ganji ..... A61F 5/56
2020/0214480 A1 * 7/2020 Haney ..... A47G 9/1045
2020/0294401 A1 * 9/2020 Kerecsen ..... G05D 1/0287
2020/0337479 A1 * 10/2020 Zurek ..... A47G 9/109

* cited by examiner

WEDGE SHAPED FITNESS ACCESSORY

RELATED APPLICATION

This application claims priority to provisional patent application U.S. Ser. No. 62/768,264 filed on Nov. 16, 2018, the entire contents of which is herein incorporated by reference.

BACKGROUND

The embodiments described herein relate generally to fitness accessories, and more particularly, to a wedge-shaped fitness accessory to enhance glute activation and ergonomics of the frog pump exercise.

The traditional frog pump exercise places the ankles in a compromised position with the soles of the feet together and limits the resistance capable of being used due to ankle stress.

Therefore, what is needed is a device designed to allow for proper foot, ankle, knee, and hip alignment during the frog pump exercise while simultaneously improving safety and effectiveness of the exercise.

SUMMARY

Some embodiments of the present disclosure include a fitness accessory for improving positioning and form during a frog pump exercise. The accessory may include a wedge shaped device. The wedge shaped device may include a base; a top opposite the base; a pair of angled side walls connecting the base and the top; a first smaller end closing a first end of the wedge shaped device; and a second larger end closing a second end of the wedge shaped device. The device may taper from a larger width at the second end to a smaller width at the first end.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
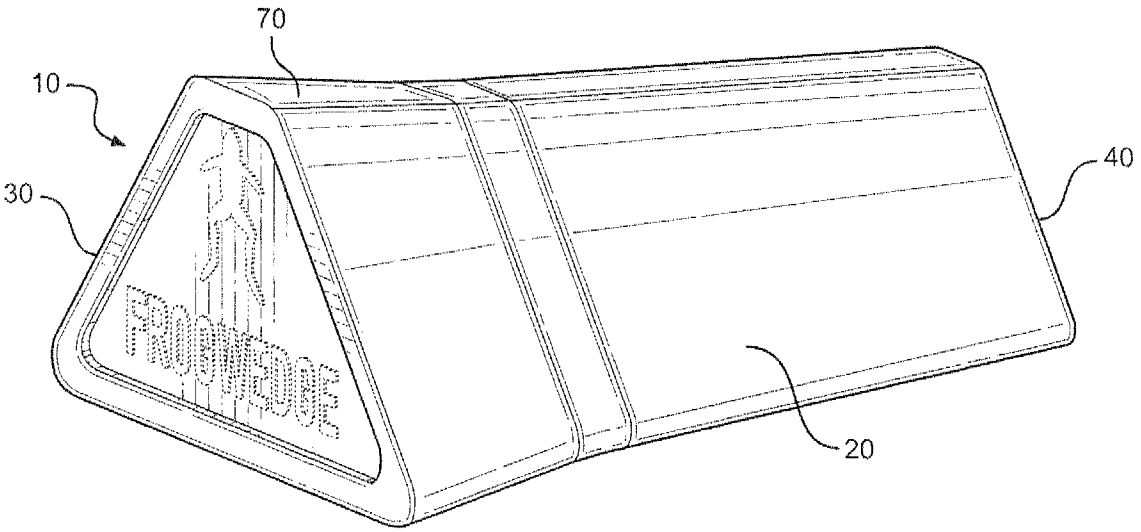
FIG. 1 is a perspective view of one embodiment of the present disclosure.
Figure 2:
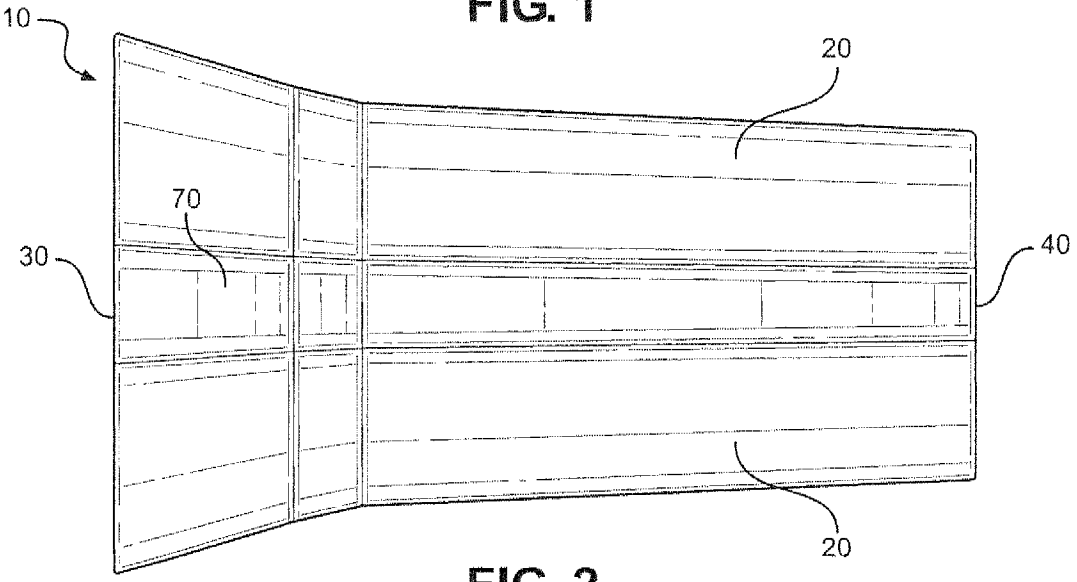
FIG. 2 is a top view of one embodiment of the present disclosure.
Figure 3:
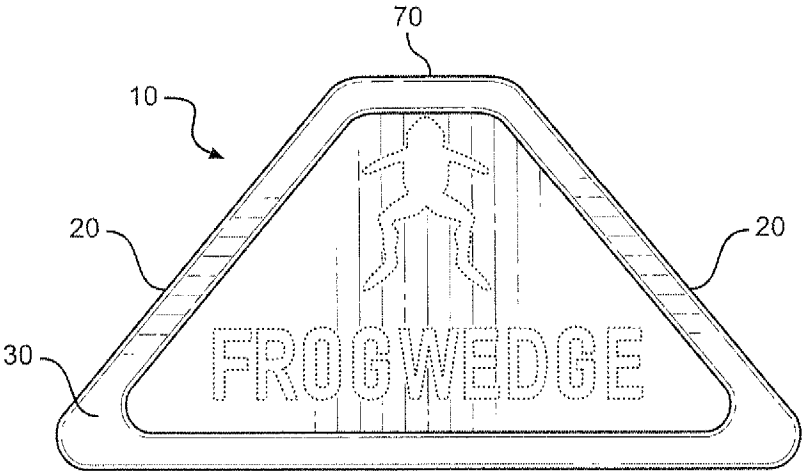
FIG. 3 is a front view of one embodiment of the present disclosure.
Figure 4:
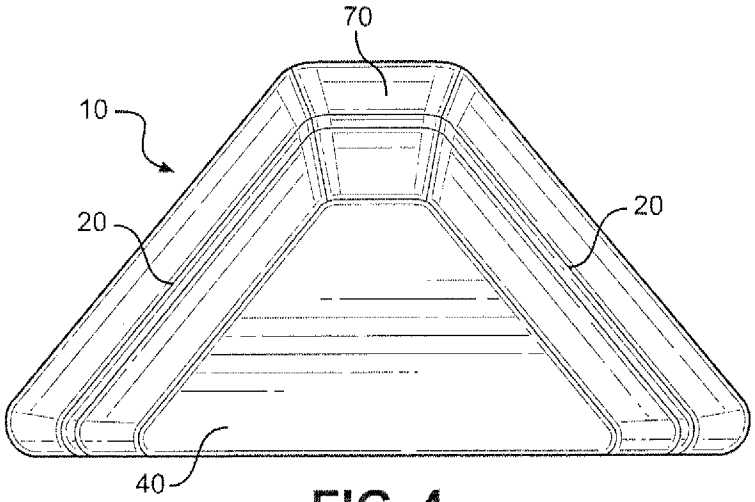
FIG. 4 is a back view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a fitness accessory and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Base
b. Top
c. Angled Walls
d. Tapered Shape

The various elements of the present disclosure may be related in the following exemplary fashion. It is not intended to limit the scope or nature of the relationships between the various elements and the following examples are presented as illustrative examples only.

By way of example, and referring to FIGS. 1-6, some embodiments of the invention include a fitness accessory 10 for improving positioning and form during a frog pump exercise, the fitness accessory 10 comprising a wedge-shaped device with a base, a top 70 opposite the base, a pair of angled side walls 20 connecting the base and the top 70, a first smaller end 40 closing a first end of the wedge-shaped device, and a second larger end 30 closing a second end of the wedge-shaped device, wherein the device tapers from a larger with at the second end to a smaller width at the first end. As shown in the Figures, the width may flare outwards proximate to the second larger end 30.

In embodiments, the base may be larger in size than the top 70, wherein the top 70 may be comparatively narrow as comparted to the remainder of the device. Moreover, the top 70 may have a smallest or narrowest width proximate to the first smaller end 40 and a largest or widest width proximate to the second larger end 30. As shown in the Figures, each of the first smaller end 40 and the second larger end 30 may be substantially triangle shaped with a flattened top angle.

Some embodiments of the fitness accessory 10 of the present disclosure may be a solid, unitary piece. Alternatively, as shown for example in FIG. 5, an interior of the device may be substantially hollow. In embodiments with a hollow interior, the device may further comprise at least one support rib 80 extending the width (and optionally length) of the interior, such that the at least one support rib 80 provides additional strength to the accessory 10.

The fitness accessory 10 of the present disclosure may comprise any desired or suitable materials. For example, the fitness accessory 10 may comprise high-density rubber. Optionally, an outer surface of the fitness accessory 10 may comprise a gripping surface or have a gripping material layer applied thereto.

Figure 5:
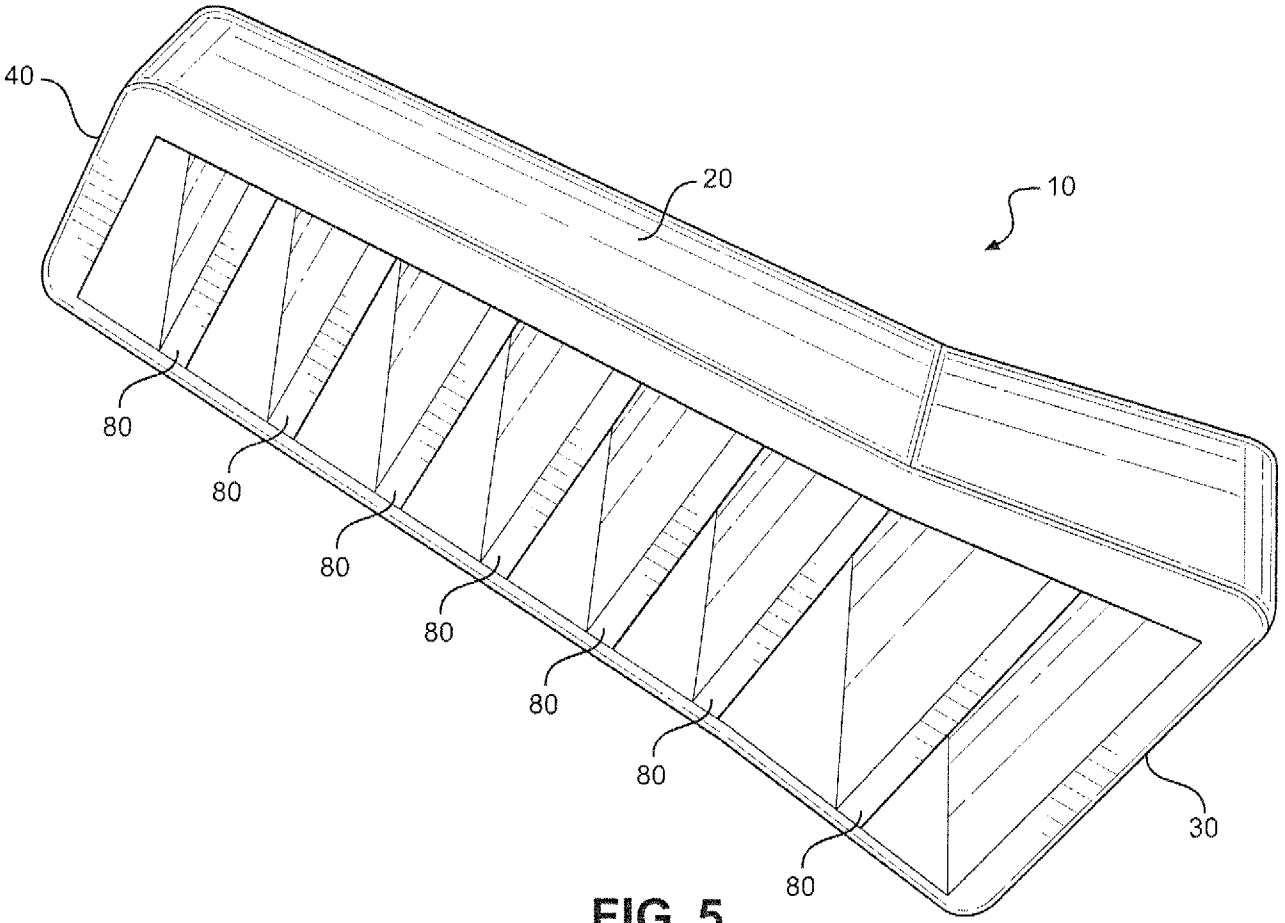
FIG. 5 is a bottom perspective view of one embodiment of the present disclosure.
Figure 6:
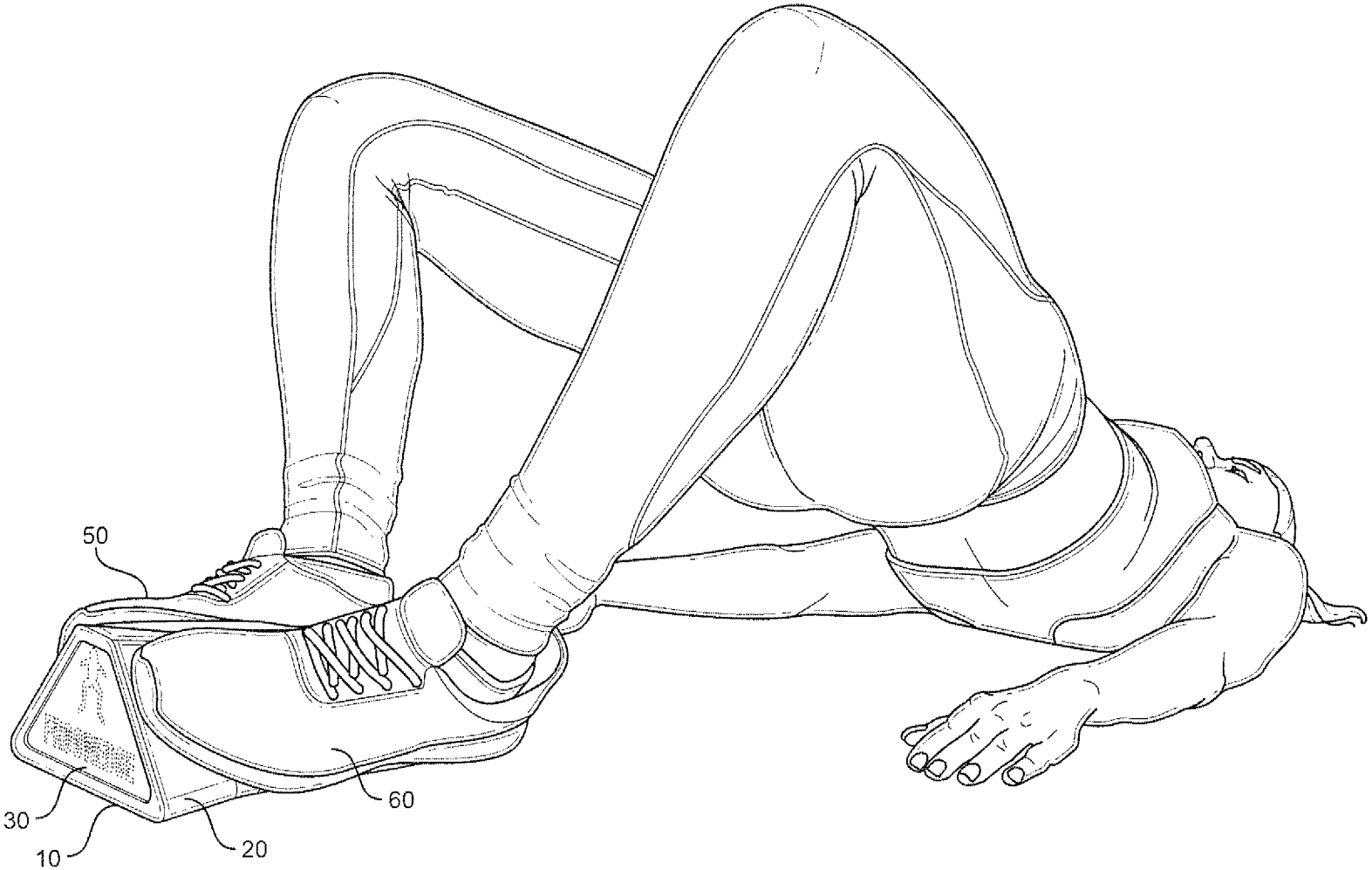
FIG. 6 is a perspective view of one embodiment of the present disclosure, shown in use.

To use the device of the present disclosure, the user may lie down and place the fitness accessory 10 between his or her right foot 50 and left foot 60, as shown in FIG. 5, with the soles of the feet 50,60 on the angled sidewalls 20 and the second larger end 30 positioned toward the user's toes. To use the accessory 10, the user may press his or her feet 50, 60 into the accessory 10, thrusting the hips into the air, which completed the frog pump, hip thrust, or glute bridge exercise.

Experimental Data:

Exercises were completed both with and without the fitness accessory 10 of the present disclosure, and the percent activation of both the gluteus maximus and the gluteus medius were measured. Specifically, electrodes were attached to two muscles, the gluteus maximus and the gluteus medius, on a subject. The subject then laid down and performed a regular hip bridge exercise with feet flat on the ground with a technician's hands pressing on the subjects hips to establish a maximal voluntary contraction (MVC). The subject then performed the regular hip bridge and a frog bridge without the resistance from the technician's hands.

Data was calculated by comparing the MVCs (100%) with the body weight (BW) activation. The results are shown below, wherein the first row of data is the actual raw value of BW activation and the percent activation is relative to the MVC established at the beginning.

| | Glute Bridge without Fitness Accessory | | Frog Pump with Fitness Accessory | |
|---|---|---|---|---|
| Muscle | Gluteus Maximus | Gluteus Medius | Gluteus Maximus | Gluteus Medius |
| BW activation | 0.044 | 0.024 | 0.059 | 0.024333 |
| Percent Activation | 33.6% | 34.3% | 45.0% | 34.8% |

For the gluteus maximus, the glute bridge activated 33.6% of the 100% MVC, while the wedge bridge (with the fitness accessory) activated 45% of the 100% MVC. As such, using the fitness accessory of the present disclosure provided 34% better activation of the gluteus maximus. Thus, as shown by the above data, using the fitness accessory of the present disclosure results in increased percent activation of the glutes during exercises.

Additionally, in the past, while the frog position pump exercise activates more muscle, the potential MVC for the traditional hip bridge was much greater than a feet-together frog pump because of stability issues. However, using the fitness accessory of the present disclosure closes the biomechanical gap, not only providing for superior activation, but also for more stable positioning needed for a much greater MVC as well.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A fitness accessory for improving positioning and form during a frog pump exercise, the fitness accessory comprising:

a wedge shaped device comprising:

a base;

a top opposite the base;

a pair of angled side walls connecting the base and the top;

a first smaller end closing a first end of the wedge shaped device; and a second larger end closing a second end of the wedge shaped device, wherein the device tapers from a larger width at the second end to a smaller width at the first end; wherein the top and the base extend between the angled side walls and the first and second ends; wherein the top is narrower than the base along an entire length of the wedge-shaped device; wherein an interior of the device is hollow; a plurality of support ribs positioned within the hollow interior, said support ribs extending between and connected to the angled side walls.

2. The fitness accessory of claim 1, wherein the at least one support rib extends along a width of the hollow interior.

3. The fitness accessory of claim 1, wherein the top has a smallest width proximate to the first smaller end and a largest width proximate to the second larger end.

4. The fitness accessory of claim 1, wherein an outer surface of the device comprises a gripping material.

* * * * *